US006283806B1

(12) United States Patent
Schmidt et al.

(10) Patent No.: US 6,283,806 B1
(45) Date of Patent: Sep. 4, 2001

(54) LOCKING MECHANISM FOR AN OUTBOARD MOTOR

(75) Inventors: David M. Schmidt, Oshkosh; Robert Kleeman; John E. Gulke, both of Fond du Lac, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/575,510

(22) Filed: May 22, 2000

(51) Int. Cl.[7] ..... B63H 5/125
(52) U.S. Cl. ..... 440/53; 440/55; 440/900
(58) Field of Search ..... 440/53, 900, 55; 114/172

(56) References Cited

U.S. PATENT DOCUMENTS

| | | | | |
|---|---|---|---|---|
| 1,451,452 | | 4/1923 | Williams . | |
| 1,593,823 | | 7/1926 | Gleason . | |
| 2,846,896 | | 8/1958 | Allen | 74/495 |
| 3,382,837 | | 5/1968 | Aumack | 115/18 |
| 3,808,851 | | 5/1974 | Karqus et al. | 70/232 |
| 4,372,241 | | 2/1983 | Tritt | 114/162 |
| 4,521,201 | | 6/1985 | Watanabe | 440/55 |
| 4,863,405 | | 9/1989 | Hervat et al. | 440/53 |
| 4,961,392 | | 10/1990 | Ballard | 114/161 |
| 5,240,211 | * | 8/1993 | Anderson | 248/125 |
| 5,328,394 | | 7/1994 | Onoue et al. | 440/61 |
| 5,582,527 | | 12/1996 | Nakamura | 440/55 |
| 5,868,591 | | 2/1999 | Kleeman et al. | 440/53 |
| 6,045,188 | * | 4/2000 | Schooler | 297/362.14 |

* cited by examiner

*Primary Examiner*—Stephen Avila
(74) *Attorney, Agent, or Firm*—William D. Lanyi

(57) ABSTRACT

A locking mechanism for an outboard motor is provided which prevents a moveable segment of the outboard motor from rotating about a steering axis relative to a stationary segment of the outboard motor. A slidable rod is disposed within a tilt tube of the outboard motor and is connected by a connecting link to the moveable segment of the outboard motor. If a locking device, such as a pin, is inserted through holes in the tilt tube and the rod, relative movement of the tilt tube and the rod can be prevented. If this relative movement is prevented, the moveable segment of the outboard motor is locked in position relative to the stationary segment of the outboard motor to which the tilt tube is attached.

16 Claims, 3 Drawing Sheets

LOCKING MECHANISM FOR AN OUTBOARD MOTOR

BACKGROUND OF THE INVENTION

1. Field of the Invention

The present invention generally relates to a locking mechanism for an outboard motor and, more particularly, to a locking mechanism that includes a sliding rod within a tube in combination with a locking pin that prevents the rod from sliding within the tube and, since the rod is attached to a movable segment of the outboard motor, also prevents movement of the movable segment of the outboard motor relative to a stationary segment of the outboard motor or to the transom of a boat to which the outboard motor is attached.

2. Description of the Prior Art

Outboard motors are well known to those skilled in the art. Typically, outboard motors are provided with a bracket and at least one mechanism that allows the outboard to be tilted relative to its bracket and relative to the transom of a boat and also allows the outboard motor to be swiveled about a generally vertical centerline to allow steering of the boat.

Under certain circumstances, boat operators tilt the outboard motor up to a maximum position when the outboard motor is not in use. This situation can occur when the outboard motor is used as an auxiliary propulsion system, such as on sailboats or on boats powered by another outboard motor. Also, outboard motors are typically tilted to a maximum position when the boat operator is towing the boat on a trailer. During this type of operation, with the outboard motor tilted to its maximum upward position, the movable segment of the outboard motor, comprising the engine, cowl, driveshaft housing, and lower gearcase, can move to a rotated position relative to its steering axis and to a stationary segment of the outboard motor which comprises a bracket that is attachable to a transom of a boat. With the movable segment of the outboard motor turned to non central extreme position while tilted upward to a maximum position, shock loads can exert potentially damaging forces on various components of the outboard motor. For example, repeated shock loads can cause fatigue of certain support and structural members such as support brackets. These shock loads can either be caused by wave action if the boat is in operation on water or, alternatively, by undulations in a road surface if the boat is being transported on a trailer behind an automobile.

Various types of locking mechanisms are known to those skilled in the art. U.S. Pat. No. 5,868,591, which issued to Kleeman et al on Feb. 9, 1999, discloses a swivel lock for an outboard motor. First and second latch mechanisms are provided that allow a boat operator to prevent the movable and stationary portions of an outboard motor from moving relative to each other. This device can be used during shipping, transportation, or use of an outboard motor in conjunction with a sailboat in which the rudder of the sailboat is used for steering, and it is desirable to maintain the movable and stationary portions of an outboard motor rigidly with respect to each other. A first latch mechanism is attached to the movable portion of the outboard motor, and a second latch mechanism is attached to the stationary portion of an outboard motor. The second latch portion is rotatable to place a receptacle into a region where a locking device can retain it.

U.S. Pat. No. 4,863,505, which issued to Hervat et al on Sep. 5, 1989, describes an outboard motor tilt lock device. The marine propulsion device comprises a transom bracket adapted to be mounted on the transom of a boat and having a side and upper surface. It also comprises a swivel bracket mounted on the transom bracket for pivotal movement relative to the transom bracket about a generally horizontal tilt axis and between an operating position and a raised position. A tilt lock shaft has first and second ends extending through the swivel bracket along a second generally horizontal axis spaced rearwardly from and substantially parallel to the tilt axis. A lever member mounted on the shaft and including a contact pad extending parallel to and radially offset from the second axis and further including at least one leg extending substantially perpendicularly relative to the contact pad are also provided.

U.S. Pat. No. 5,582,527, which issues to Nakamura on Dec. 10, 1996, describes a steering system for an outboard motor. The steering device for the outboard motor retains the motor under constant, although adjustable, pressure to releasably hold it in a plurality of secured positions. Moreover, the releasable restraining device permits rotation of the motor about the tilt and trim axis while the retaining device is in any of a plurality of retained positions.

U.S. Pat. No. 5,328,394, which issued to Onoue et al on Jul. 12, 1994, described a steering system for a marine propulsion unit. A hydraulic assisted mechanism for marine propulsion drives wherein the hydraulic assist is operated by a control valve having its valve element actuated by a wire actuator that is operated by the steering mechanism. The actuating element that interconnects the wire actuator to the control valve element is supported for movement in a variety of embodiments so as to confine the movement in the same direction as the valve element.

U.S. Pat. No. 4,961,392, which issued to Ballard on Oct. 9, 1990, describes a self locking mechanical steering helm. The steering helm for a boat includes a worm gear set having a worm fixed on the steering wheel shaft and a worm gear clustered with a cable sprocket for controlling the movement of the steering which extends to the outdrive of the boat.

U.S. Pat. No. 3,808,851, which issued to Kargus et al on May 7, 1974, describes an outboard motor lock. The invention relates to an improved locking device for preventing the theft or accidental dislodgment during use of outboard motors. The device consists of a one piece slotted tubular member which is adapted to slide over and to engage and lock against member the heads of the clamp screws for the motor supporting bracket. This tubular member is provided with a series of aligned holes adapted to receive the shackle of a padlock or equivalent locking means in such manner that removal of the tubular member from locking engagement with the heads of the clamping screws is effectively prevented.

U.S. Pat. No. 4,521,201, which issued to Watanabe on Jun. 4, 1985, describes a steering device for an outboard motor. The steering device for an outboard motor releasably restrains the motor in a predetermined position which can be automatically released upon the exertion of more than a predetermined force to the motor to steer it in the event of an emergency. The releasable restraining device is also automatically engageably upon return of the motor to its first position and can be manually released.

U.S. Pat. No. 3,382,837, which issued to Aumack on May 14, 1968, describes an outboard motor steering control mechanism that relates generally to a device to maintain an outboard motor boat on a previously determined course and more particularly to such a device that adjustably and mechanically determines the positional relationship between the outboard motor steering rod and a boat carrying such motor.

U.S. Pat. No. 1,451,452, which issued to Williams on Apr. 10, 1923, describes a tiller lock. The tiller lock is usable in conjunction with an outboard motor.

U.S. Pat. No. 2,846,896, which issued to Allen on Aug. 12, 1958, describes an outboard motor steering stabilizer. The device is adapted to be utilized in conjunction with an outboard motor and more particularly to a device for holding the tiller in a selected position against movement of the tiller due to vibrations so that a fisherman or other user of the outboard engine need not tend the tiller but may be engaged in fishing or be occupied elsewhere.

U.S. Pat. No. 1,593,823, which issued to Gleason on Jul. 27, 1926, describes a tiller positioning device. The device is usable in conjunction with an outboard motor.

U.S. Pat. No. 4,372,241, which issued to Tritt on Feb. 8, 1983, describes a rudder assembly for sailboats and the like which comprises a rudder support frame pivotally attached to the stern portion of a boat, a substantially horizontal tiller fixedly attached to the upper portion of the rudder support frame, a rudder blade pivotally coupled to the rudder support frame, a rudder blade control mechanism including kickup control arm pivotally coupled to the upper portion of the rudder blade and an interconnecting kickup control member pivotally coupled between the kickup control arm and the substantially horizontal tiller to selectively move the rudder blade between a first or lower position and a second or upper position. The mechanism further includes a lock member fixedly attached to the kickup control arm disposedly to selectively engage the substantial horizontal tiller to lock the rudder blade in the lower or upper position.

The patents described above are hereby explicitly incorporated by reference in the description of the present invention.

In view of the prior art, it would be significantly beneficial if an outboard motor could be provided with a simple and generally inexpensive mechanism that allows the boat operator to lock the outboard in a preselected position, such as a central position.

SUMMARY OF THE INVENTION

A locking mechanism for an outboard motor made in accordance with the present invention comprises a tube, such as a tilt tube, attached to a stationary segment of the outboard motor, wherein the stationary segment is attachable to a transom of a boat. It also comprises a rod that is slidably disposed at least partially within the tube and a connecting link attached to the rod and to the moveable segment of the outboard motor, whereby movement of the movable segment relative to the stationary segment causes the rod to slide within the tube. A locking device, such as a pin, is disposable in contact with both the tube and the rod to prevent relative movement between the tube and the rod when the locking device is simultaneously in contact with both the tube and the rod.

The present invention can incorporate a tube which is the tilt tube of the outboard motor about which the moveable segment can pivot relative to the stationary segment. The connecting link can be attached to a swivel head of the moveable segment of the outboard motor. A ball and socket connector can be connected between the connecting link and the moveable segment of the outboard motor and the connecting link can be rotatable relative to the rod. This can be accomplished by a ball and socket device. The connecting link can also be rotatably connected to the moveable segment of the outboard motor. The precise connection mechanisms between the connecting link and either the rod or the moveable segment of the outboard motor can be of various designs that are appropriate to allow the required freedom of movement of the components relative to each other while maintaining the components in contact with each other.

BRIEF DESCRIPTION OF THE DRAWINGS

The present invention will be more fully and completely understood from a reading of the description of the preferred embodiment in conjunction with the drawings in which.

DESCRIPTION OF THE PREFERRED EMBODIMENT

Figure 1:
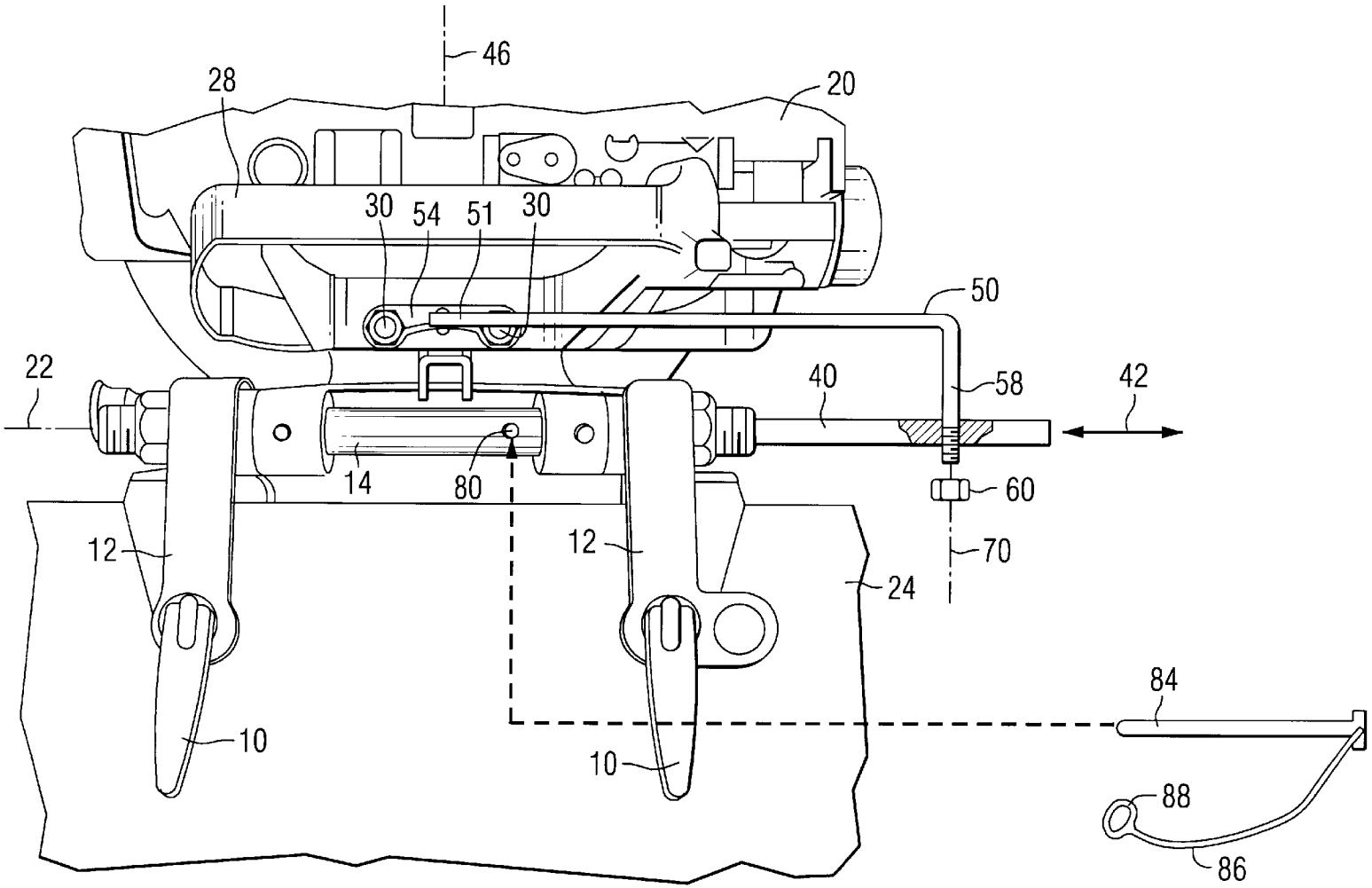
FIG. 1 shows a front view of an outboard motor incorporating the present invention.

FIG. 1 shows a preferred embodiment of the present invention associated with an outboard motor. Screw clamps 10 are supported by clamp brackets 12 which is rigidly attached to a tilt tube 14. The rotatable connection between a moveable segment 20 of the outboard motor and a stationary segment to which the clamp brackets 12 are attached allows the moveable segment 20 to rotate about axis 22 and tilt the moveable segment upward. This allows the moveable segment 20 to rotate relative to both the stationary segment of the outboard motor and the transom 24 of a boat to which the outboard motor is attached. A lifting handle 28 is attached to the moveable segment 20 of the outboard motor by two bolts identified by reference numerals 30. The configuration described immediately above is well known to those skilled in the art.

With continued reference to FIG. 1, it can be seen that a rod 40 is inserted into the tilt tube 14 and, as indicated by arrow 42, is slideably within the central opening of the tilt tube 14 in a direction along the central axis of the tilt tube. The moveable segment 20 of the outboard motor is rotatable about steering axis 46. A connecting link 50 is attached to the rod 40 and to the moveable segment 20 of the outboard motor. More specifically, a first end 51 of the connecting link is attached to a bracket 54 that is bolted to the handle by bolts 30. A hole extending through a portion of the bracket 54 allows the first end 51 of the connecting link 50 to be rotatably attached to the bracket 54 by a bolt or rivet, as shown. The second end 58 of the connecting link 50 is attachable to the rod 40 through a hole formed through the rod. In certain embodiments of the present invention, the second end 58 of the connecting link 50 can be threaded to receive a bolt 60 which retains the relationship between the connecting link 50 and the rod 40.

It can be seen that rotation of the moveable segment 20 about steering axis 46 will cause the bracket 54 to move with the moveable segment 20. This, in turn, causes the first end 51 of the connecting link 50 to move with the bracket 54 and the moveable segment 20. As a result, the second end 58 of the connecting link 50 also moves since it is attached to rod 40. This causes the rod 40 to move relative to the tilt tube 14 and slide relative to the tilt tube 14. The relative connections between the connecting link 50 and both the bracket 54 and the rod 40 can be of various types. For example, in FIG. 1, the first end 51 is attached to the bracket 54 by the simple rivet or bolt. This allows relative pivoting of the first end 51 relative to the bracket 54 about the vertical axis in FIG. 1. Similarly, the insertion of the second end 58 through a hole in the rod 40, as shown in FIG. 1, allows a simple rotation of the second end 58 relative to the rod 40 as represented by axis 70. It should be understood that the first and second ends of the connecting link 50 can be attached to their respective associated components in alternative manners, such as with a ball and socket arrangement that allows additional freedom of movement of these components relative to each other.

With continued reference to FIG. 1 it can be seen that a hole 80 is formed radially through the tilt tube 14 at a preselected location. Similarly, a hole is formed through rod 40. This hole in rod 40 is not shown in FIG. 1, but will be described in greater detail below. When the hole in rod 40 is aligned with the hole 80 in the tilt tube 14, a pin 84 can be inserted through both holes. The pin 84 shown in FIG. 1 is provided with a tether 86 that has a end loop 88. After the pin 84, which operates as a locking device, is inserted into hole 80 and through the hole in rod 40, the end loop 88 can be attached around the inserted end of the pin 84 to retain the pin in position. It should be understood by those skilled in the art that many different mechanisms can be used to retain the pin 84 in its position through hole 80 and through the hole in the rod 40. When pin 84 is inserted through the two aligned holes in the tube 14 and the rod 40, relative sliding movement between the rod 40 and the tilt tube is prevented. Because of the connection of the connecting link 50 between rod 40 and bracket 54, rotation of the moveable segment 20 is prevented as long as the pin 84 remains in its position relative to the hole 80 and the hole through the rod 40. This locks the moveable segment 20 of the outboard motor in its central position and prevents rotation of the moveable segment 20 about steering axis 46.

Figure 2:
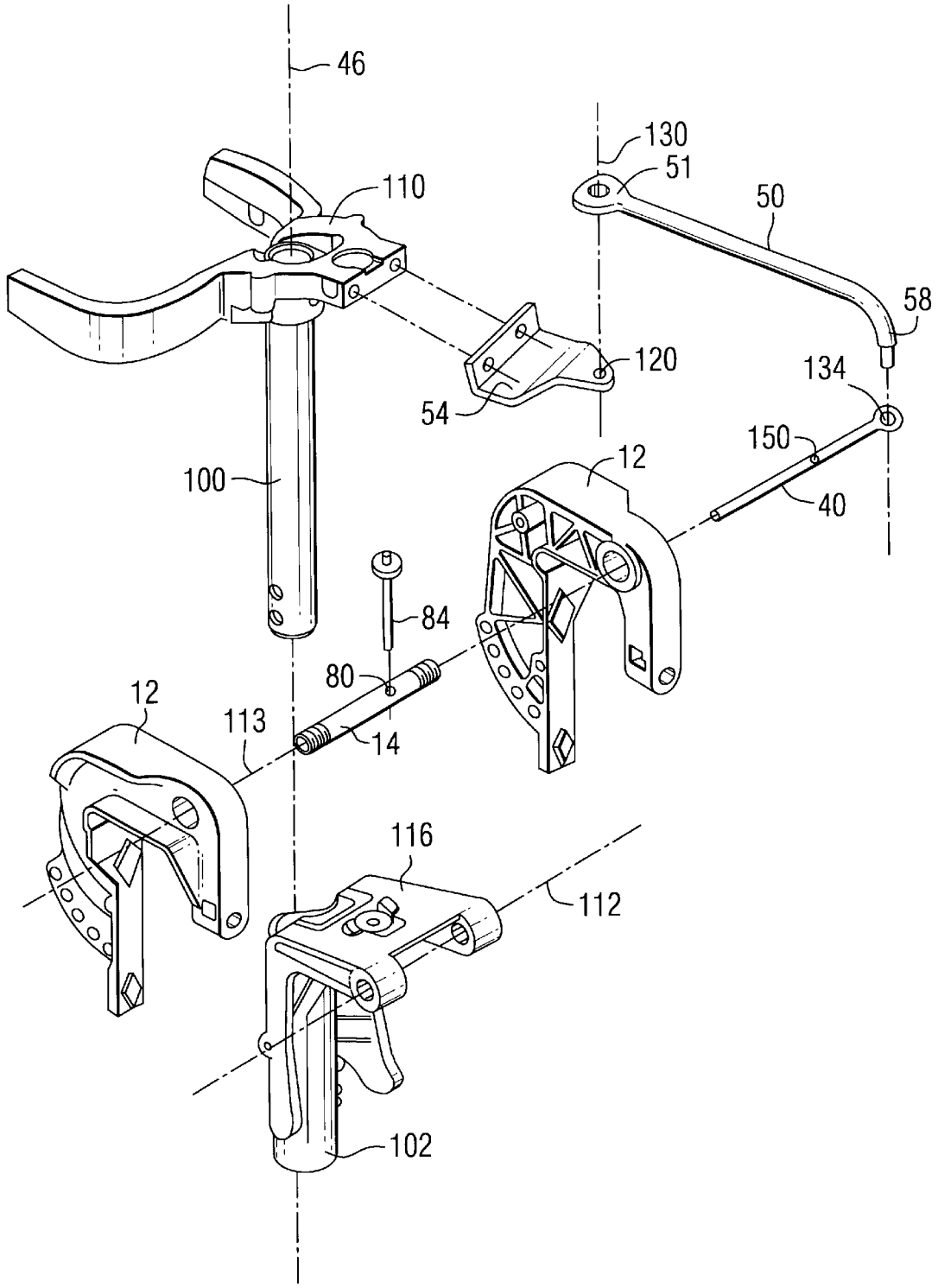
FIG. 2 is an exploded view of certain selected components of an outboard motor showing the relative positions of the outboard motor components and the present invention.

FIG. 2 is an exploded view of certain relevant parts of an outboard motor showing the relative positions of the components and the elements of the present invention. A rotatable tube 100 is insertable into a stationary tube 102 to allow the moveable segment of the outboard motor to pivot about its steering axis 46. The bracket 54 is attachable to the rotatable component 110 by the bolts 30 described above in conjunction with FIG. 1. Clamp brackets 12 are attachable to the transom 24 of a boat and are part of the stationary segment of the outboard motor. Axis 112 is aligned with axis 113 to allow the segment identified by reference numeral 116 to be disposed between the clamp brackets with the tilt tube 14 aligned with axis 113. The first end 51 of the connecting link 50 is attached to the bracket 54 by providing a connector through the hole (e.g.) a bolt, rivet, or ball) in the first end 51 and the hole 120 in bracket 54. This allows the connecting link 50 to remain attached to the bracket 54, but be pivotable about axis 130. The second end 58 of the connecting link 50 is attached to the rod 40 which is, in turn, inserted through the central opening of the tilt tube 14. The second end 58 of the connecting link 50 can be inserted through a hole 134 in the rod 40 to allow relative rotation between the connecting link and the rod 40 while maintaining contact between these two components. A hole 150 is formed through the rod 40 and is alignable with hole 80 in tilt tube 14 when the rod 40 is inserted into the tilt tube 14 and the moveable segment is centered relative to the stationary segment. Alignment between holes 80 and 150 allows the pin 84 to be inserted through the tilt tube 14 and the rod 40 to lock these two components together and prevent further sliding of the rod 40 within the tilt tube 14. This, in turn, prevents further rotation of the tube 100 and its rotatable component 110 about the steering axis 46.

Figure 3:
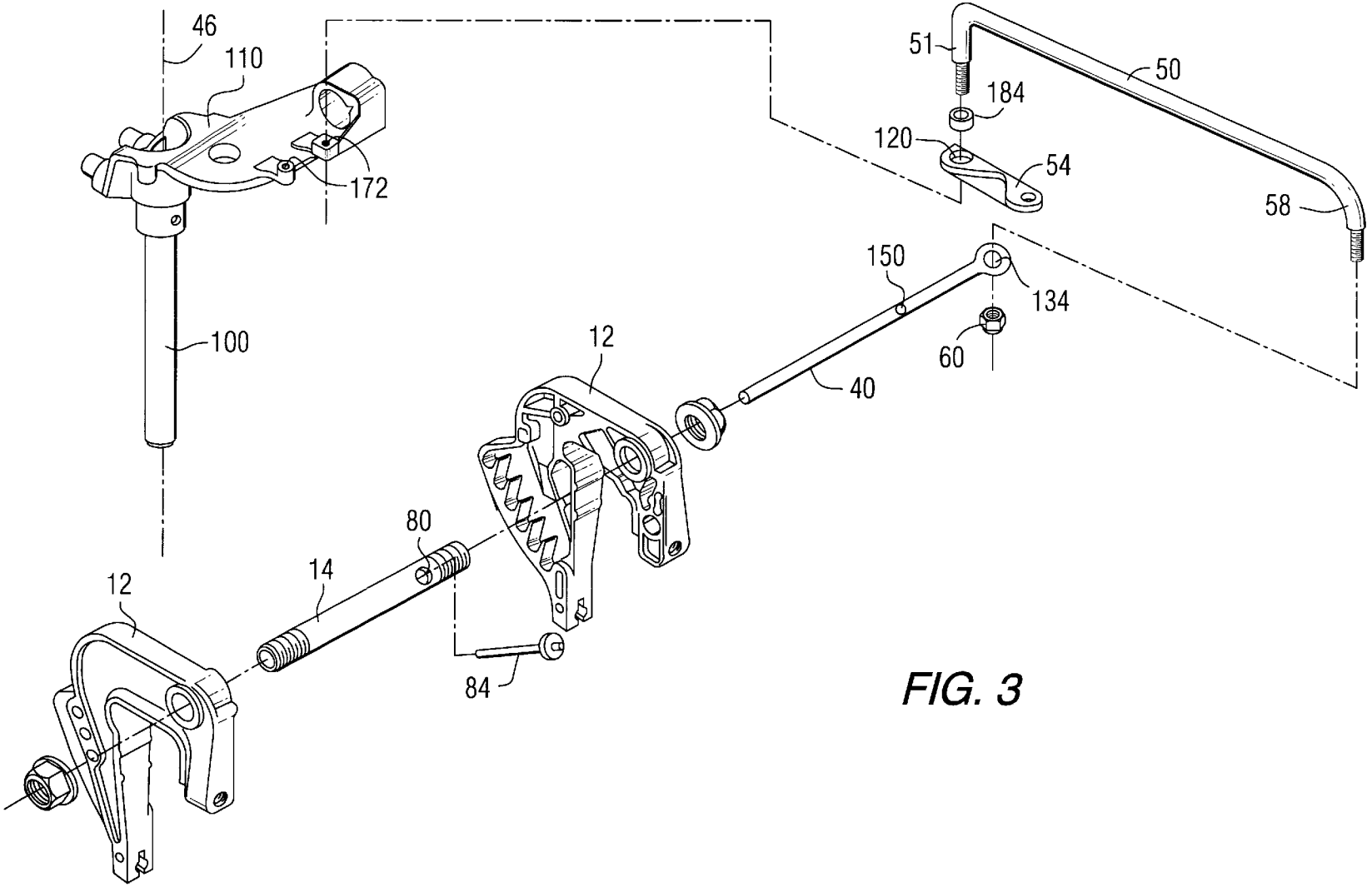
FIG. 3 is another exploded view of selected components of an outboard motor showing relative positions between those components and components of the present invention.

FIG. 3 shows an exploded view of an alternative embodiment of the present invention that is only slightly changed in comparison to the embodiments described above in conjunction with FIGS. 1 and 2. Although shaped slightly differently, the clamp brackets 12 and the rotatable tube 100 function in a manner similar to that described above. The bracket 54 is attachable to the rotatable component 110 by providing bolts extending through the holes in the bracket and through the holes identified by reference numeral 172. The bracket 54 is slightly rotated from its position in FIG. 3 and attached to the rotatable member 110 by those bolts through holes 172 and the first end 51 of the connecting link 50 is attached to hole 120 in bracket 54. A socket component 184 provides certain additional freedom of movement of the connecting link 50 relative to the bracket 54, but the basic function of the first end 54 is to maintain contact between the bracket 54 and the connecting link 50 with sufficient freedom of movement to allow the moveable segment 20 of the outboard motor to pivot about the steering axis 46 when the pin 84 is not inserted through holes 80 and 150. The second end 58 is threaded to receive the nut 60 after the threaded end is inserted through hole 134 in rod 40. This provides the connection between the rod 40 and the rotatable component 110 by the connecting link 50. The second end 58 of the connecting link 50 is rotatable within hole 134 to allow the necessary freedom of movement of the moveable segment 20 of the outboard motor when pin 84 is not extended through holes 80 and 150. As in the embodiments described above, rod 40 is slidable within tilt tube 14 and hole 150 is alignable with hole 80 when the moveable segment of the outboard motor is in its central position.

It should be understood that the embodiments shown in FIGS. 2 and 3 are functionally identical, but implore certain components that are distinctly different from each other. As an example, the connecting link 50 in FIG. 2 is shaped differently than the connecting link 50 in FIG. 3. This difference is a function of the particular style and model of outboard motor for which they are to be used. In addition, the brackets 54 in FIGS. 2 and 3 are shaped differently and are attached to the rotatable member 110 in a slightly different manner. This difference is provided to accommodate slightly different designs of rotatable members 110 that are used in different outboard motor designs. Described functionally, the connecting link 50 serves the function of coordinating the movement of the rod 40 to the rotation of the moveable segment 20. In other words, rotation of the moveable segment about its steering axis 46 causes an associated sliding movement of the rod 40 within the tilt tube 14. These movements are coordinated with each other because of the attachment of the connecting link 50 to both the rod 40 and the moveable segment 20. In this way, the presence of the locking device or pin 84 through holes 80 and 150 not only prevents the sliding movement of rod 40 in tilt tube 14 but, more importantly, prevents further rotation of the moveable segment 20 about its steering axis 46.

One of the most advantages of the present invention, in addition to fixing the position of the moveable segment 20 about its steering axis 46 to prevent damage as described above, is the simplicity of the apparatus. The bracket 54, the tilt tube 14, and the connecting link 50 are all standard components that are presently available in commercial quantities from various manufacturers of outboard motor, such as the Mercury Marine division of Brunswick Corporation. The connecting link 50 and its associated hardware are used in remote steering applications in which the outboard motor is steered from a position other than close to the position of the outboard motor at the transom of a boat. The rod 40 is custom made for the present invention, but is similar to the end of a steering actuator used in other applications. As a result, most of the individual components necessary to provide the advantages of the present invention are already commercially available. The provisions of holes, 80 and 150, and the pin 84 allow an effective locking mechanism to be provided when combined with the commercially available connecting link 50 and bracket 54 in combination with the custom rod 40. As a result, a locking mechanism can be provided for virtually any style of outboard motor by simply incorporating the connecting link 50 and bracket 54 that would normally be used to provide a remote steering application for that style of outboard motor and providing a custom rod 40 that is equivalent to the end segment of a steering actuator rod that would be used if a remote steering application is provided for that style of outboard motor.

In all of the embodiments of the present invention, a rod 40 is slidably disposed at least partially within tube 14 and a connecting link 50 is attached to the rod 40 and to the moveable segment 20 of the outboard motor. This connection, because of the configuration of the first and second ends, 51 and 58, of the connecting link 50, allows the moveable segment 20 of the outboard motor to rotate about its steering axis 46. A locking device, such as pin 84, is disposable in contact with both the tube 14 and rod 40 to prevent relative movement between the tube 14 and the rod 40 when the locking device 84 is simultaneously in contact with both the rod 40 and tube 14. This is accomplished by inserted pin 84 through holes 80 and 150 simultaneously. In order to implement the concepts of the present invention, very few additional parts are needed to adapt the outboard motor for these purposes. The tilt tube 14 is a standard part of the outboard motor as are the other components in FIGS. 2 and 3 except the rod 40, connecting link 50, and pin 84. If a hole 80 is provided in the tilt tube 14 and a hole 150 is provided in the rod 40, the advantages of the present invention can be realized.

Although the present invention has been described with particular specificity and illustrated to show a preferred embodiment, it should be understood that alternative embodiments are also within its scope.

What is claimed is:

1. A locking mechanism for an outboard motor having stationary and movable segments, comprising:

a tube attached to said stationary segment of said outboard motor, said stationary segment being attachable to a transom of a boat;

a rod slidably disposed at least partially within said tube;

a connecting link attached to said rod and is attached to said movable segment of said outboard motor by a rotatable connector which allows relative rotation to occur between said connecting link and said movable segment of said outboard motor, whereby movement of said movable segment relative to said stationary segment causes said rod to slide within said tube;

a locking device being disposable in contact with both said tube and said rod to prevent relative movement between said tube and said rod when said locking device is simultaneously in contact with both said tube and said rod.

2. The mechanism of claim 1, wherein:

said tube is a tilt tube of said outboard motor.

3. The mechanism of claim 1, wherein:

said connecting link is attached to a swivel head of said movable segment of said outboard motor.

4. The mechanism of claim 1, wherein:

said rotatable connector is a ball and socket connector between said connecting link and said movable segment of said outboard motor.

5. The mechanism of claim 1, wherein:

said connecting link is rotatably connected to said rod.

6. A locking mechanism for an outboard motor having stationary and movable segments, comprising:

a tube rigidly attached to a transom of a boat, said stationary segment of said outboard motor being attachable to said transom of said boat;

a rod slidably disposed at least partially within said tube;

a connecting link attached to said rod and is attached to said movable segment of said outboard motor by a rotatable connector which allows relative rotation to occur between said connecting link and said movable segment of said outboard motor, whereby movement of said movable segment relative to said stationary segment causes said rod to slide within said tube;

a locking device being disposable in contact with both said tube and said rod to prevent relative movement between said tube and said rod when said locking device is simultaneously in contact with both said tube and said rod.

7. The mechanism of claim 6, wherein:

said tube is directly attached to said stationary segment of said outboard motor.

8. The mechanism of claim 7, wherein:

said tube is a tilt tube of said outboard motor.

9. The mechanism of claim 8, wherein:

said connecting link is attached to a swivel head of said movable segment of said outboard motor.

10. The mechanism of claim 9, further comprising, wherein:

said rotatable connector is a ball and socket connector between said connecting link and said movable segment of said outboard motor.

11. The mechanism of claim 9, wherein:

said connecting link is rotatably connected to said rod.

12. A locking mechanism for an outboard motor having stationary and movable segments, comprising:

a tube rigidly attached to a transom of a boat, said stationary segment of said outboard motor being attachable to said transom of said boat, said tube being directly attached to said stationary segment of said outboard motor, said tube being a tilt tube of said outboard motor;

a rod slidably disposed at least partially within said tube;

a connecting link attached to said rod and is attached to said movable segment of said outboard motor by a rotatable connector which allows relative rotation to occur between said connecting link and said movable segment of said outboard motor, whereby movement of said movable segment relative to said stationary segment causes said rod to slide within said tube;

a locking device being disposable in contact with both said tube and said rod to prevent relative movement between said tube and said rod when said locking device is simultaneously in contact with both said tube and said rod.

13. The mechanism of claim 12, wherein:

said connecting link is attached to a swivel head of said movable segment of said outboard motor.

14. The mechanism of claim 12, wherein:

said rotatable connector is a ball and socket connector between said connecting link and said movable segment of said outboard motor.

15. The mechanism of claim 14, wherein:

said connecting link is rotatably connected to said rod.

16. The mechanism of claim 15, wherein:

said connecting link is rotatably connected to said movable segment of said outboard motor.

* * * * *